US010172394B2

(12) United States Patent
Hyslop

(10) Patent No.: US 10,172,394 B2
(45) Date of Patent: Jan. 8, 2019

(54) BIB TOY TEETHING DEVICE

(71) Applicant: Melissa Hyslop, Burlington (CA)

(72) Inventor: Melissa Hyslop, Burlington (CA)

(73) Assignee: Melissa Hyslop, Burlington (CA)

( * ) Notice: Subject to any disclaimer, the term of this patent is extended or adjusted under 35 U.S.C. 154(b) by 0 days.

(21) Appl. No.: 15/784,049

(22) Filed: Oct. 13, 2017

(65) Prior Publication Data

US 2018/0103690 A1 Apr. 19, 2018

Related U.S. Application Data

(60) Provisional application No. 62/409,879, filed on Oct. 19, 2016.

(51) Int. Cl.

| | |
|---|---|
| ***A41B 13/00*** | (2006.01) |
| ***A41B 13/10*** | (2006.01) |
| ***A45F 5/00*** | (2006.01) |
| ***A45F 5/02*** | (2006.01) |
| ***A63H 3/00*** | (2006.01) |
| ***A63H 3/02*** | (2006.01) |
| *A61J 17/00* | (2006.01) |
| *A61J 17/02* | (2006.01) |

(52) U.S. Cl.

CPC ..... *A41B 13/10* (2013.01); *A45F 5/00* (2013.01); *A45F 5/02* (2013.01); *A63H 3/003* (2013.01); *A63H 3/02* (2013.01); *A45F 2005/008* (2013.01); *A61J 17/001* (2015.05); *A61J 17/02* (2013.01)

(58) Field of Classification Search

CPC ..... A41B 13/10; A61J 17/02; A63H 33/006

See application file for complete search history.

(56) References Cited

U.S. PATENT DOCUMENTS

| | | | | |
|---|---|---|---|---|
| 4,543,669 | A | 10/1985 | Katz | |
| 4,710,979 | A | 12/1987 | Bull | |
| 4,719,650 | A | 1/1988 | Milloy | |
| 4,829,601 | A | 5/1989 | Spanier | |
| 5,046,980 | A | 9/1991 | Tai | |
| 5,385,573 | A | 1/1995 | Wright | |
| 5,477,560 | A | 12/1995 | Shope | |
| 5,813,584 | A * | 9/1998 | Mauser | A45F 5/00 224/605 |
| D442,766 | S | 5/2001 | Dunn | |
| 6,442,759 | B1 | 9/2002 | Straham, Jr. | |
| 7,032,248 | B1 * | 4/2006 | Gutilla | A41B 13/10 2/49.1 |
| 7,048,160 | B2 | 5/2006 | Anderson | |
| 2003/0014078 | A1 | 1/2003 | Robbins | |
| 2004/0267319 | A1 | 12/2004 | Stack | |
| 2005/0091723 | A1 | 5/2005 | Niederhofer | |
| 2011/0209261 | A1 | 9/2011 | Lyle | |

(Continued)

FOREIGN PATENT DOCUMENTS

GB 2506972 4/2014

*Primary Examiner* — Adam Waggenspack

(57) ABSTRACT

A bib toy teething device is described having a bib body with a collar and a lower portion comprising an aperture for receiving a detachable toy. The toy has a teether for securely positioning the teether close to the infant and preventing soiling of the teether. A pair of straps can attached the toy to the bib through the aperture, or be removed from the bib to secure the toy around the wrist of an infant or another object.

17 Claims, 6 Drawing Sheets

(56) References Cited

U.S. PATENT DOCUMENTS

| | | | | |
|---|---|---|---|---|
| 2012/0041487 | A1* | 2/2012 | Griffis | A45F 5/02 606/234 |
| 2016/0243005 | A1 | 8/2016 | Paicely | |

* cited by examiner

BIB TOY TEETHING DEVICE

CROSS-REFERENCE TO RELATED APPLICATIONS

This application claims priority to U.S. provisional patent application Ser. No. 62/409,879, filed Oct. 19, 2016, the contents of which are hereby incorporated by reference herein in its entirety.

FIELD OF THE INVENTION

This invention relates generally to a protective covering for children's clothing. In particular, the present invention pertains to a bib, toy and teething device combination.

BACKGROUND

Bibs have long been used to protect a baby's clothing while the baby eats or plays. Bibs prevent food, drink, and bodily fluids like saliva, from soiling the clothing. Many times parents and caregivers leave a bib on a child for numerous hours in order to protect clothing.

Teething rings or teethers are devices for babies to use to soothe gums and provide a teething baby to bite on. The biting activity relieves the pain of teething and also helps the baby's new teeth to break through the gum line. Typically, a teething device is unattached and can be thrown or dropped easily. As known, infants are prone to dropping toys, teething rings, pacifiers, and other devices, exposing them to unsanitary and dirty conditions. These devices have to be constantly picked up and then should be cleaned before the child can resume playing with or teething the devices. In addition, a common problem is that a baby may drop the toy that they are playing with on the floor, and this often becomes a repetitive action. If a floor is dirty, it may not be possible to give the toy or teething device back to the baby. Most infants also lack the manual dexterity and the attention to grasp a toy or teething device for an extended period. Adults can use handles and hold toys and teething devices for the baby, however, this action may be tedious and not always convenient for the adult.

U.S. Pat. No. 4,719,650 to Milloy describes a pacifier bib formed from a flat panel of fabric having a wishbone shape which includes a flap extending downwardly adapted to have its distal end folded over into a closed loop for attaching the handle of a pacifier to the bib. The pacifier can be removed, however there is no integrated means provided for attaching the pacifier to an infant at an alternative location for easy access.

United Kingdom patent application GB2506972 to Livingstone et al. describes a bib having a first pliable material for attachment around the neck of a child and a chewable portion attached to the pliable material for teething. The teething portion is made from a resilient material and securely attached to the bib portion.

This background information is provided for the purpose of making known information believed by the applicant to be of possible relevance to the present invention. No admission is necessarily intended, nor should be construed, that any of the preceding information constitutes prior art against the present invention.

SUMMARY OF THE INVENTION

It is an object of the invention to provide a multi-purpose bib device that includes a removable toy and teether combination. The invention is configured such that the toy and teether may be detached from the bib and mounted to a child's wrist with the ability for the child to mouth, chew, play and also potentially interchange different toys to the wrist band.

In one aspect, the present system introduces a novel bib device and teething or toy device combination. In yet another aspect, the present device introduces a novel three-in-one teething bib device with a detachable stuffed toy that may be affixed using a securing means. In certain embodiments, the detachable stuffed toy may be affixed using strap-like devices that may wrap around a baby's body part or other items such as car seat straps, carriage handles, etc. The bib device with a detachable toy combination provides for detachment such that the toy with attached teether may also act as an independent teething device to provide comfort to a teething baby. The present device can reduce the unnecessary, repetitive dropping or throwing of toys and teethers by an infant and help to protect the infant from unsanitary play or contamination during teething. The toy and teething device is releasably attached to the bib providing a multi-faceted toy and teether that is easily accessible to the infant while wearing the bib device. Realizing one aspect of the device is a new bib, toy, and teether device combination, wherein the toy may be removable from the bib and the teething device may be removable from the toy, in order to provide a three-in-one mechanism that aids the infant in teething while preventing the toy and teether from falling on the ground.

In another aspect there is provided a bib toy teething device comprising: a bib body having an upper portion comprising a collar for releasably securing about the neck of a child and a lower portion comprising an aperture; a detachable toy comprising: a toy body; and a pair of straps attached to the toy body, at least one of the pair of straps configured to be received into the aperture on the lower portion of the bib body, the pair of straps comprising complementary strap attachment means to attach the pair of straps together; and a teether attached to the detachable toy.

In an embodiment of the device, the aperture on the lower portion of the bib body is a slit. In another embodiment of the device, the lower portion of the bib body comprises a pair of parallel slits.

In another embodiment of the device, when the detachable toy is attached to the bib body, the teether extends toward the collar.

In another embodiment of the device, the teether comprises a teether aperture for receiving a teether securing strap on the detachable toy.

In another embodiment of the device, the teether securing strap comprises a closure with a complementary closure on the detachable toy to releasably attach the teether.

In another embodiment, the device comprises two teether securing straps with a complementary closure on each strap.

In another embodiment of the device, the complementary closure is selected from Velcro®, a snap closure, a clasp, a buckle, a clip, and a magnet.

In another embodiment of the device, the teether is selected from a ring, pacifier, soother, tag, rattle, and figure.

In another embodiment of the device, the teether is detachable from the detachable toy.

In another embodiment of the device, the bib body comprises at least one of an absorbent material and a waterproof material.

In another embodiment of the device, the complementary strap attachment means on the pair of straps on the detachable toy comprise at least one of Velcro®, a snap closure, a clasp, a buckle, a clip, and a magnet.

In another embodiment of the device, the detachable toy is stuffed toy.

In another embodiment of the device, the aperture is between 5 cm-25 cm from the collar.

In another embodiment of the device, the pair of straps attached to the toy body forms a loop sized to fit around the wrist of an infant.

In another aspect there is provided a bib toy teething device comprising: a flexible bib body having an upper portion comprising a collar for releasably securing about the neck of a child and a lower portion comprising a pair of parallel slits; a detachable toy comprising: a toy body; and a pair of straps attached to the toy body, the pair of straps comprising complementary strap attachment means to secure the pair of parallel straps together through at least one of the pair of parallel slits; and a teether releasably attached to the detachable toy.

In an embodiment of the device, the teether is releasably attached to the detachable toy with a teether securing strap having a complementary closure on the detachable toy. In another embodiment of the device, the complementary strap attachment means comprises at least one of Velcro®, a snap closure, a clasp, a buckle, a clip, and a magnet. In another embodiment of the device, the pair of parallel slits are between 5 cm-25 cm from the collar.

In another aspect there is provided a bib toy teething device comprising: a bib body having an upper portion forming a collar for releasably securing about the neck of a child and a lower portion comprising an aperture; a detachable toy comprising: a toy body; and a strap attached to the toy body, the strap configured to be received into the aperture on the lower portion of the bib body to attach the detachable toy to the bib body; and a teether attached to the detachable toy.

In an embodiment of the device, the detachable toy comprises a pair of straps.

BRIEF DESCRIPTION OF THE FIGURES

For a better understanding of the present invention, as well as other aspects and further features thereof, reference is made to the following description which is to be used in conjunction with the accompanying drawings, where.

DETAILED DESCRIPTION OF THE INVENTION

Figure 1:
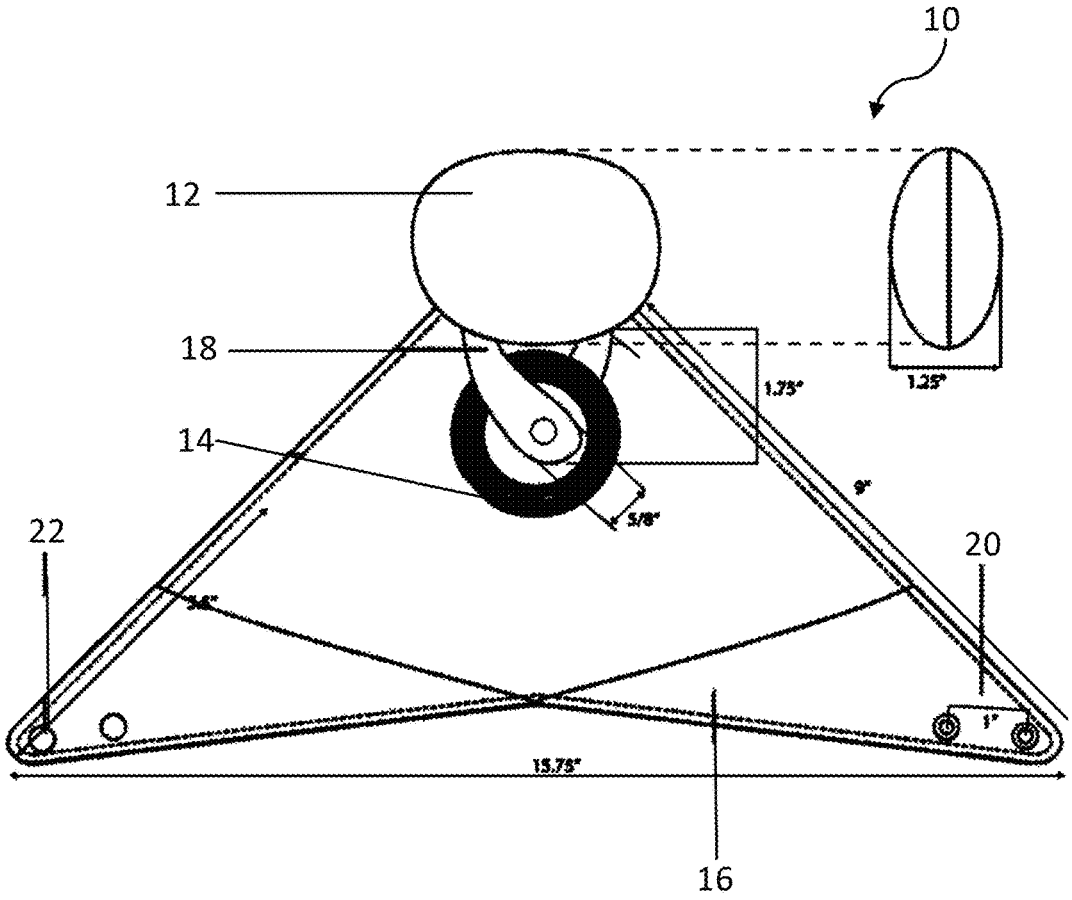
FIG. 1 illustrates one embodiment of the bib toy teething device.

Unless defined otherwise, all technical and scientific terms used herein have the same meaning as commonly understood by one of ordinary skill in the art to which this invention belongs.

As used in the specification and claims, the singular forms "a", "an" and "the" include plural references unless the context clearly dictates otherwise. As used in this specification and appended claims, the term "or" is generally employed in its sense including "and/or" unless the content clearly dictates otherwise.

The term "comprising" as used herein will be understood to mean that the list following is non-exhaustive and may or may not include any other additional suitable items, for example one or more further feature(s), component(s) and/or element(s) as appropriate.

All numeric values are herein assumed to be modified by the term "about", whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

The term "infant" or "baby" as used herein encompasses all young people who would wear a bib, such as those referred to as infants, babies, and toddlers. It is also understood that the presently described bib device may also be worn by people with special needs or the elderly.

The terms "teether" and "teething device" as used herein can refer to any object meant for chewing or sucking by an infant or baby. The teether can be made of any durable material suitable for sucking, gumming or chewing. The teether can be any shape, and is preferably a ring, pacifier, soother, tag, rattle, or figure.

The following description should be read with reference to the drawings wherein like reference numerals indicate like elements throughout several views. The drawings, which are not necessarily to scale, depict illustrative embodiments of the claimed invention.

A bib, toy, and teether combination device is disclosed, wherein a three-in-one mechanism provides a sanitary, wearable device for teething infants and babies. The overall device comprises a bib, a detachable toy, and a teether, wherein the teether is affixed to the detachable toy and the detachable toy may be detached from the bib and affixed to an infant's wrist or other body part, or the detachable toy may be affixed to the bib, ensuring the toy and teething ring are easily accessible to the user. In one embodiment, a three-in-one tool, teether, and bib device is disclosed. In a preferred embodiment, the detachable toy is capable of being affixed using strap mechanisms to a body part like a baby's wrist, hand, or arm. When the toy is attached to an infant, the toy and teether then avoids being thrown or dropped. The toy and teether may also be affixed to a carriage handle, car seat, or other item that has handles. The securing means may include a snapping device, Velcro®, or other securing means. The teething device or teether may include a standard teething ring, a pacifier, or other soother or device to comfort an infant. The removable toy may be also affixed to the bib device with a strap through at least one aperture. Once the strap is inserted through at least one aperture, it can then be secured through the use of a securing means like Velcro®, snapping mechanisms, or other securing mechanisms. Preferably, the bib body has two apertures for receiving one or two straps on the detachable toy, preventing the detachable toy from rotating when attached to the bib. Preferably, the aperture or apertures are a slit or parallel slits to further prevent rotation of the toy and to securely position the toy on the bib.

Turning now to the figures, FIG. 1 illustrates one embodiment of the bib teething device 10. The bib teething device 10 shown has a bib body 16 with detachable toy 12 with a teether 14, shown here as a teething rin. The bib body 16 has at least one aperture at its lower portion to secure the toy to the bib body 16. The teether 14 is attached to the detachable toy 12 via teether securing means 18 shown as a pair of straps each ending in a complementary closing means. The complementary closing means may comprise a Velcro® mechanism, snap mechanism, clasp, buckle, or any other securing device capable of attaching a pair of straps together, or capable of attaching a single strap to the detachable toy 12, around the teether 14. In another embodiment, the teether securing strap 18 can be a single strap attached to the detachable toy 12, the distal end of the single strap having a closure mechanism, such as a snap, clasp, buckle, clip, magnet, or Velcro®, and complementary closing means on the detachable toy 12 to form a loop around teether 14.

The teether 14 may include any element designed for teething and/or sucking by an infant. The teether 14 shown is a ring-style teether, though it is understood that a variety of teethers may be attached to the teether securing means 18, such as but not limited to a pacifier, ring, tag, rattle, figure, or any teething or sucking device having an aperture capable of receiving the teether securing means 18. Non-limiting examples of teether 14 include a teeth soother or any other object with a handle or loop that may be affixed to the detachable toy 12 by teething securing means 18. The teether can be smooth, or textured with nubs, striations, patterns, or a combination thereof, to provide the infant with elements for gum stimulation. The teether may be made of any resilient, flexible, or hard material, or combination thereof, suitable and safe for and infant to gum, suck, and/or chew. Preferably the teether is detachable from the detachable toy 12. In another embodiment, the teether 14 may also be integrated with or securely attached to the detachable toy 12 such that it is not removable from the toy. In certain embodiments, the detachable toy 12 may be a stuffed toy, plush toy, or other comparable toy.

The bib body 16 may comprise any clothing covering in any reasonable size in order to protect the infant child's clothing. The material of the bib body 16 may be cloth, fleece, or any type of fabric, and may be waterproof or non-waterproof, and preferably flexible. The upper portion of the bib body 16 has an edge with a pair of attachment arms 20 to wrap around the neck of an infant which when attached forms a collar. Each attachment arm 20 has a bib securing means 22 to secure the pair of attachment arms 20 around the infant's neck. The bib securing means 22 can be a snap, Velcro™, clasp, buckle, or any other attachment device suitable for use in an infant garment. Bib securing means 22 shown in FIG. 1 is a pair of snaps on each attachment arm 20; this enables the diameter of the neck opening once the attachment arms 20 are attached to be adjustable and also provides dual attachment means, to securely attach the bib body to the infant. Other bib securing means are also contemplated, including but not limited to Velcro®, hook and loop closure system, a snap closure, a clasp, a buckle, a clip, and a magnet. A preferred embodiment of a series of dimensions are shown, however these are not binding but may encompass certain embodiments. The upper portion of the bib body 16 may be straight, angled, or curved, and may have additional tabs or straps, and is sized to be attached comfortably around the neck of an infant, as would be known to the skilled person. Detachable toy 12 is removably attached to the bib body 16 at an end distal to the attachment arms 20 such that it is positioned below the head of the infant when the bib toy teether device 10 is worn by the infant.

Figure 2:
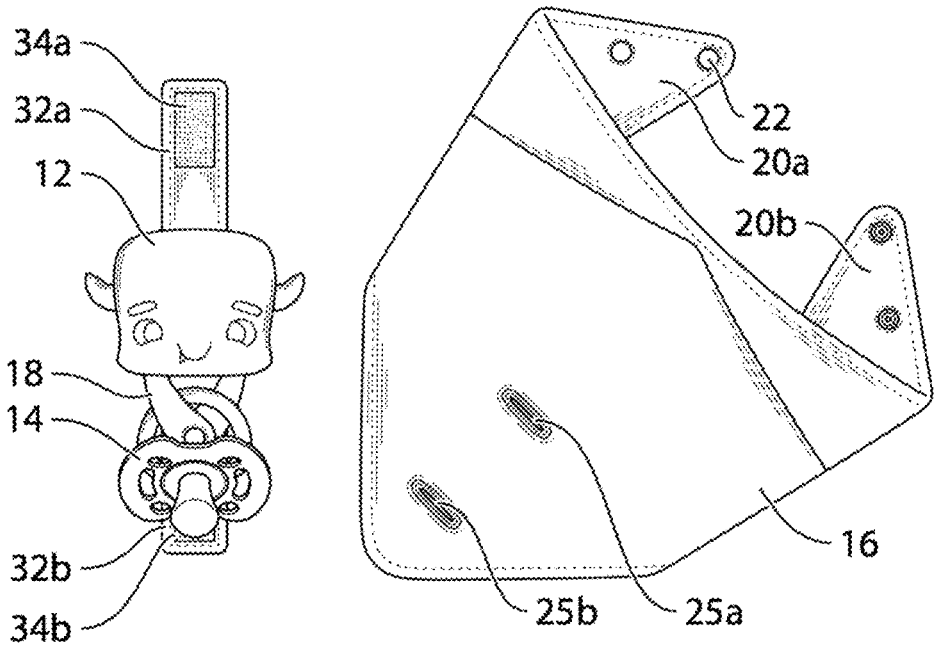
FIG. 2 illustrates an embodiment of the bib toy teething device with the toy detached from the bib.

FIG. 2 illustrates a front view of an embodiment of a bib teether device with the detachable toy 12 detached from bib body 16 at its lower portion. In the embodiment shown, the bib body 16 comprises a bib securing means 22 on both bib attachment arms 20*a*, 20*b*, and two parallel slit apertures 25*a* and 25*b* to attach the detachable toy 12 to the lower portion of the bib body, spaced from the collar at a distance that is accessible to an infant. The detachable toy 12 shown attaches to the bib body via a pair of tabs or straps 32*a*, 32*b* extending from the back side of the detachable toy 12 that are positioned at a complementary distance with the pair of slit apertures 25*a* and 25*b* such that the pair of straps 32*a*, 32*b* are configured to be received in aperture slits 25*a* and 25*b* to secure the detachable toy 12 to the bib body 16. In this embodiment with two apertures shown, the preferable distance between apertures is 2 cm-10 cm, or sufficient to provide a secure locus of attachment on the bib body. In another embodiment, the bib body 16 can comprise a single aperture and one of the pair of straps on the detachable toy can be fed through the aperture and secured to the other strap to form a loop and secure the detachable toy the bib body. The aperture can be a slit, grommet, or other aperture capable of receiving a strap.

The pair of straps 32*a*, 32*b* on the detachable toy each have a complementary fastening mechanism or strap attachment means 34*a*, 34*b*, shown in FIG. 2, to secure the pair of straps 32*a*, 32*b* to each other on the underside of bib body 16 and detachably secure the detachable toy to the bib body 16. The complementary strap attachment means 34*a*, 34*b* may be any suitable device, such as tying, snapping, buttoning, and can comprise one or more piece of Velcro®, hook and loop closure system, a snap closure, a clasp, a buckle, a clip, and a magnet, or any other attachment device or other comparable securing means suitable for an infant garment. When separated from the bib body 16 by detaching the strap attachment means 34*a*, 34*b*, the detachable toy 12 may be affixed to the infant's wrist through the pair of straps 32*a*, 32*b*, or the pair of straps 32*a*, 32*b* may be attached together to form a loop that may be grasped by the infant or secured to another device such as, for example, a stroller, crib, or car seat.

In another embodiment, the detachable toy can have a single strap with an attachment means and complementary attachment means on the detachable toy. In this embodiment, the single strap on the detachable toy can be fitted into a single aperture, or fed through two apertures on the lower portion of the bib body and secured to the detachable toy to form a loop. The single strap or pair of straps on the detachable toy preferably forms a loop sized to fit around the wrist of an infant. The distance between the attachment points of the pair of straps on the detachable toy, and thereby the circumference of the loop, is preferably between 10 cm to 20 cm to accommodate an infant wrist. With a single strap on the detachable toy, the same loop can be created with one of the attachment points on the end of the single strap and the other on the detachable toy. The strap or straps on the detachable toy can be made of any suitable pliable or flexible material and may be stretchy.

The detachable toy 12 is attached to teether 14. The teether 14 can be, for example, a teething ring, soother, or pacifier, and may be attached to the detachable toy 12 through the use of a teether securing means 18. The teether can be securely attached to the detachable toy such that it is not detachable. Preferably, the teether is detachably attached to the detachable toy with teether securing means so that it can be removed, replaced, or washed independently from the detachable toy. The teether securing means 18 for attaching the teether to the detachable toy may be a strap in combination with any suitable attachment device, such as tying, snapping, buttoning, and may comprise one or more piece of Velcro®, hook and loop closure system, a snap closure, a clasp, a buckle, a clip, and a magnet, or any other attachment device or other comparable securing means suitable for an infant garment. When fully assembled, the teether 14 can be affixed to the detachable toy 12 by use of the teether securing means 18, and then the detachable toy affixed the bib device body 16 by inserting the pair of straps 32*a*, 32*b* through slit apertures 25*a* and 25*b* and securing the straps through the use of the pair of straps 34*a*, 34*b*. When fully in use, the bib device 24 may be secured by use of the bib securing means 22 around an infant baby's neck.

Figure 3:
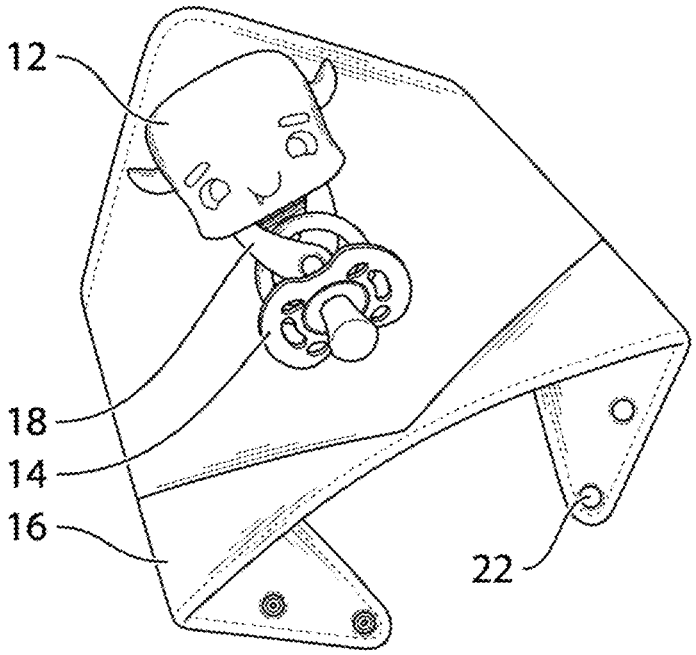
FIG. 3 illustrates an embodiment of the bib toy teething device with the toy attached to the bib.

Shown in FIG. 3 is a front view of the bib toy teether combination device fully assembled. When fully assembled, the teether 14 may be affixed to the detachable toy 12 by use of the teething securing means 18. In this embodiment, the detachable toy 12 is affixed to the bib body 16 by inserting the pair of straps 32*a*, 32*b* through the slit apertures 25*a* and 25*b* (shown in FIG. 2) and securing the straps through the use of snap mechanisms, Velcro® or other comparable securing means. Without being bound by theory, it is noted that when the detachable toy is securely attached to the bib body such that it is prevented from rotating or hanging lower than the bottom edge of the bib body, the teether can be positioned in a way that it is held in a substantially upward position pointing toward the collar of the bib body. When the combination bib with detachable toy is worn by an infant, positioning of the teether in this way enables teething on the teether while maintaining the lower portion of the bib body in a substantially extended position on the torso of the infant. When the combination device is fully accessible, it may provide a toy for a baby to play with, a teething device for the baby to use to sooth his gums, and a bib device to protect the baby's clothing. Because all corresponding parts are affixed to each other, the toy and teething device may remain within the baby's reach, and away from unsanitary conditions like the floor. Because babies tend to lack the strength to hold toys and teething devices for long periods of time, the three in one combination device provides all necessary parts in reach of the baby without requiring the baby to constantly grip the items. Further, parents and caregivers are not required to constantly hold the items for the baby, as they are always within reach of the child.

Figure 4:
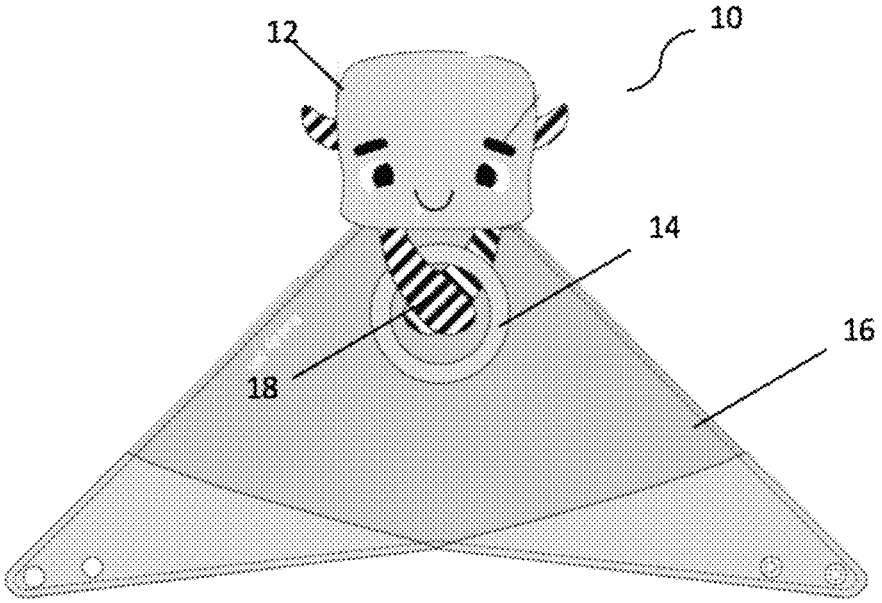
FIG. 4 illustrates a front view of an embodiment of the bib toy teething device.

FIG. 4 illustrates an example of one embodiment of the bib toy teether device 10. Herein, as shown, the bib toy teether 10 combination device comprises a detachable toy 12, a teether 14, a bib body 16, and a teether securing means 18. In certain embodiments, the detachable toy 12 may be any detachable stuffed toy, plush, or other comparable toy. The bib body 16 may be comprised of any clothing covering in any size in order to protect the infant child's clothing. The teething device or teether 14 may include any teether mechanism, including a teeth soother or any other object with a handle or loop that may be affixed to the stuffed toy by a means of a teether securing means 18. The teether securing means 18 may comprise Velcro®, hook and loop closure system, a snap closure, a clasp, a buckle, a clip, and a magnet, or any other securing device suitable for an infant garment.

Figure 5:
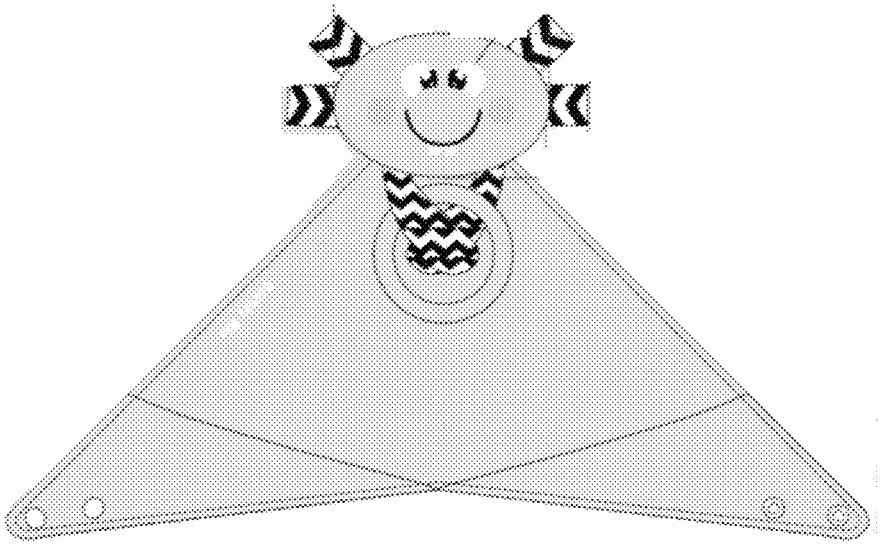
FIG. 5 illustrates a front view of an embodiment of the bib toy teething device.

FIG. 5 illustrates a drawing of an embodiment of the bib toy teether combination device. Focusing on the bib, the bib comprises a main bib body. The main bib body is the portion of the bib that covers and protects the infant's clothing from food, drink, bodily fluids, etc. In certain embodiments, the bib body may be made from a durable, flexible material, including a plastic composition or a suitable cloth material that is easily cleanable. In certain embodiments the bib device comprises a bib securing means for attaching the bib around an infant's neck. The bib securing means for attaching the bib to the infant's neck may be by any suitable device, such as tying, snapping, buttoning, and can comprise Velcro®, hook and loop closure system, a snap closure, a clasp, a buckle, a clip, and a magnet, or any other securing means suitable for an infant garment. The bib securing means is preferably adjustable to accommodate a variety of neck sizes and/or provide a backup securing means around an infant's neck as required.

Figure 6:
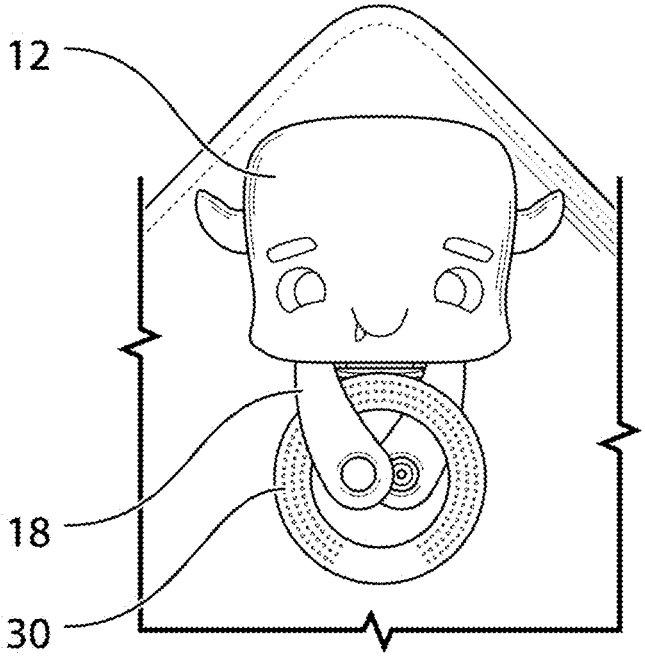
FIG. 6 illustrates an enlarged front view of the toy and teether.

FIG. 6 illustrates an enlarged figure of a plush toy and teething device. In this embodiment the plush detachable toy 12 is shown with a teething ring 30. The teething ring 30 is secured to the detachable toy 12 by a teether securing means 18. In this embodiment the teether securing means 18 includes a pair of straps, each with a complementary snap mechanism. The teething securing means 18 may also be a Velcro® mechanism or other suitable securing device.

Figure 7:
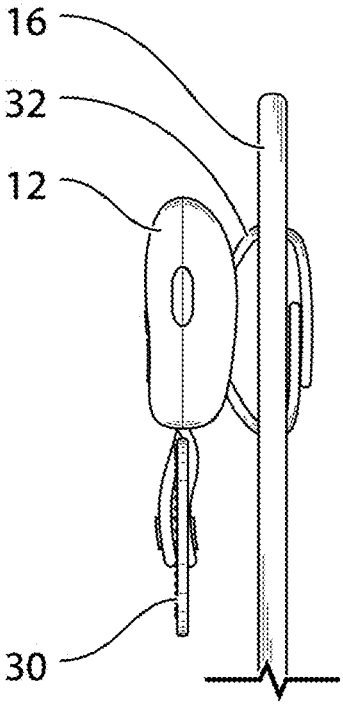
FIG. 7 illustrates an enlarged front view of the toy teether attachment to the bib.

FIG. 7 illustrates a partial back view of the plush detachable toy 12 with a teething ring 30. Herein, in a preferred embodiment, a dual strap mechanism 32 helps affix the plush detachable toy 12 and teething ring to a bib body 16.

Figure 8:
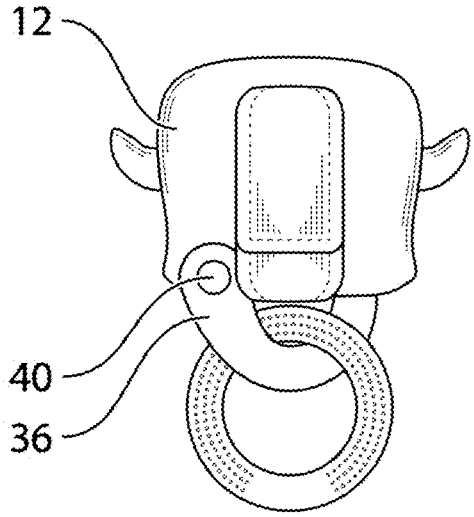
FIG. 8 illustrates an enlarged front view of the detachable toy with a single teether attachment strap.

FIG. 8 illustrates a partial back view of the detachable toy with a teething ring 30. Herein, in a preferred embodiment, a single teether securing strap 36 is permanently affixed at one end to the detachable toy 12, and the distal end of the teether securing strap 36 has a snap closure 40. A complementary closure mechanism can be found on the detachable toy 12 such that the single teether securing strap 36 can go through a teether having an aperture and securely attach to the detachable toy to detachably secure the teether to the detachable toy.

Figure 9:
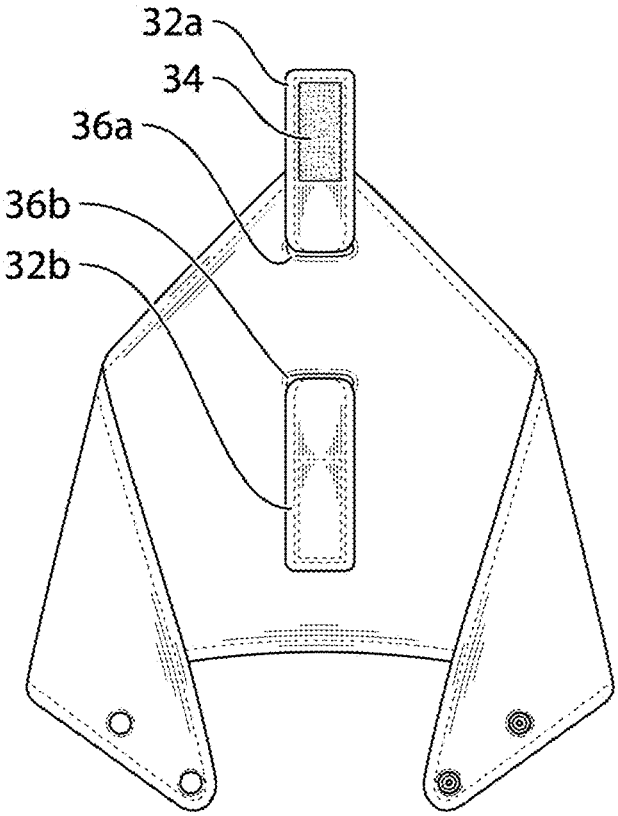
FIG. 9 illustrates an enlarged rear view of the bib with attached toy and strapping attachment means.

FIG. 9 illustrates a back view of the bib device. As shown, each of the pair of straps 32*a*, 32*b* are inserted into at least one slit aperture 36*a*, 36*b* in the lower part of the bib body. Herein, when fully assembled the strap mechanisms 32*a*, 32*b* may be affixed to the bib body through the use of a toy securing means 34. In a preferred embodiment, the strap securing means may be a Velcro® device or other appropriate securing means. It is understood that in use the detachable toy may also be attached to the bib through a single aperture or slit.

Figure 10:
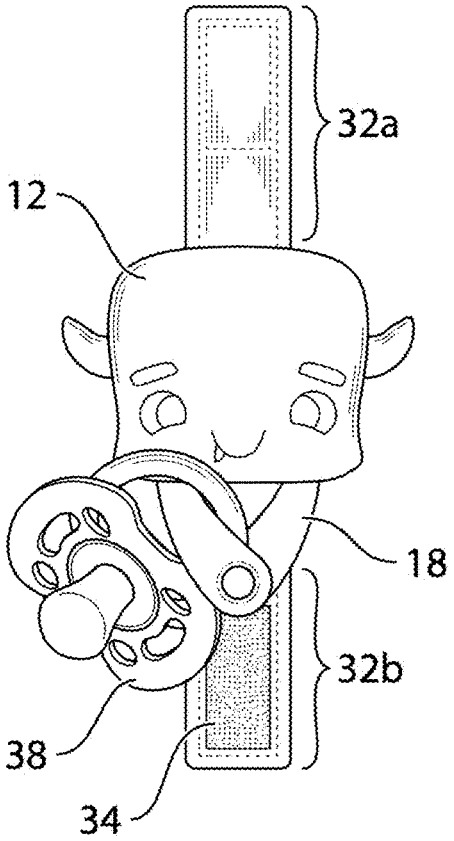
FIG. 10 illustrates the detachable toy and teether combination.

FIG. 10 illustrates a further embodiment of one embodiment of the detachable toy 12 with one embodiment of the teether device attached by the use of a teether securing means 18, with a pacifier 38 as the teether. Herein, the detachable toy 12 comprises a first strap 32*a* and a second strap 32*b*. The first strap and second strap may be made from a similar or different material as the detachable toy. Both the first strap and second strap comprise toy securing means 34. From this figure, the securing means is a hook and loop closure on the second strap 32*b*, with complementary hook and look closure on the reverse side of first strap 32*a*. The toy securing means 34 for attaching the first strap to the second strap of the toy device to the bib or to an infant may be any suitable device, such as tying, snapping, buttoning, Velcro®, or the use of a hook and loop closure system. In a preferred embodiment, as briefly explained above, the first strap 32*a* may be inserted into a first slit aperture of the bib, the second strap 32*b* may be inserted into a second slit aperture of the bib (see FIG. 8). Once each strap is inserted through the slit apertures, the straps 32*a* and 32*b* may be affixed to one another through the use of the toy securing means 34. In a further preferred embodiment, the detachable toy 12 may also be attached to an infant's body part such as an arm or wrist. Herein, the first strap 32*a* and the second strap 32*b* may be wrapped around the infant's wrist and affixed using the toy securing means 34. In other embodiments, the detachable toy 12 may be attached to other devices such as car seat handles, carriage handles, seat straps, etc.

All publications, patents and patent applications mentioned in this specification are indicative of the level of skill of those skilled in the art to which this invention pertains and are herein incorporated by reference. The invention being thus described, it will be obvious that the same may be varied in many ways, and that various alternatives to the embodiments of the disclosure described herein may be employed in practicing the disclosure. Elements of an implementation of the device descried herein may be independently implemented or combined with other implementations. Such variations are not to be regarded as a departure from the scope of the invention, and all such modifications as would be obvious to one skilled in the art are intended to be included within the scope of the following claims.

I claim:

1. A bib toy teething device comprising:

a bib body having an upper portion comprising a collar for releasably securing about the neck of a child and a lower portion comprising a pair of apertures;

a detachable toy comprising:

a toy body;

a pair of straps attached to the toy body, each one of the pair of straps configured to be received into one of the pair of apertures on the lower portion of the bib body, the pair of straps comprising complementary strap attachment means to attach the pair of straps together on the underside of the bib body; and a teether attached to the detachable toy, wherein the pair of apertures provides a locus of attachment to securely position the toy body onto the bib body such that the toy body is prevented from rotating relative to the bib body, and wherein the pair of straps in the apertures and the toy hold the teether in an upward position pointing towards the collar of the bib body while the lower portion of the bib is maintained in a downward and fully extended position such that a baby wearing the bib around its neck can teethe on the teether while the lower portion of the bib body is in the downward and fully extended position.

2. The device of claim 1, wherein the pair of apertures on the lower portion of the bib body is a pair of parallel slits.

3. The device of claim 1, wherein when the detachable toy is attached to the bib body, the teether extends toward the collar.

4. The device of claim 1, wherein the teether comprises a teether aperture for receiving a teether securing strap on the detachable toy.

5. The device of claim 4, wherein the teether securing strap comprises a closure with a complementary closure on the detachable toy to releasably attach the teether.

6. The device of claim 4, comprising two teether securing straps with a complementary closure on each strap.

7. The device of claim 1, wherein the teether is selected from a ring, pacifier, soother, tag, rattle, and figure.

8. The device of claim 1, wherein the teether is detachable from the detachable toy.

9. The device of claim 1, wherein the bib body comprises at least one of an absorbent material and a waterproof material.

10. The device of claim 1, wherein the complementary strap attachment means on the pair of straps on the detachable toy comprise at least one of a hook and loop closure, a snap closure, a clasp, a buckle, a clip, and a magnet.

11. The device of claim 1, wherein the detachable toy is stuffed toy.

12. The device of claim 1, wherein the aperture is between 5 cm-25 cm from the collar.

13. The device of claim 1, wherein the pair of straps attached to the toy body forms a loop sized to fit around the wrist of an infant.

14. A bib toy teething device comprising:

a flexible bib body having an upper portion comprising a collar for releasably securing about the neck of a child and a lower portion comprising a pair of parallel slits;

a detachable toy comprising:

a toy body; and a pair of straps attached to the toy body, each one of the pair of straps comprising complementary strap attachment means to secure the pair of straps together through the pair of parallel slits on the underside of bib body; and a teether releasably attached to the detachable toy, wherein the aperture pair of parallel slits provides a locus of attachment to securely position the toy body on the bib body such that the toy is prevented from rotating relative to the bib body, and wherein the pair of straps in the apertures and the toy hold the teether in an upward position pointing towards the collar of the bib body while the lower portion of the bib is maintained in a downward and fully extended position such that a baby wearing the bib around its neck can teethe on the teether while the lower portion of the bib body is in the downward and fully extended position.

15. The device of claim 14, wherein the teether is releasably attached to the detachable toy with a teether securing strap having a complementary closure on the detachable toy.

16. The device of claim 14, wherein the complementary strap attachment means comprises at least one of a hook and loop closure, a snap closure, a clasp, a buckle, a clip, and a magnet.

17. The device of claim 14, wherein the pair of parallel slits are between 5 cm-25 cm from the collar.

* * * * *